US005587720A

United States Patent [19]

Fukuta et al.

[11] Patent Number: 5,587,720

[45] Date of Patent: Dec. 24, 1996

[54] FIELD EMITTER ARRAY AND CLEANING METHOD OF THE SAME

[75] Inventors: Shinya Fukuta; Keiichi Betsui, both of Kawasaki, Japan

[73] Assignee: Fujitsu Limited, Kawasaki, Japan

[21] Appl. No.: 277,351

[22] Filed: Jul. 19, 1994

Related U.S. Application Data

[63] Continuation of Ser. No. 971,618, Nov. 6, 1992, abandoned.

[30] Foreign Application Priority Data

Nov. 8, 1991 [JP] Japan ..... 3-293343

[51] Int. Cl.[6] ..... G09G 3/10

[52] U.S. Cl. ..... 345/75; 313/309

[58] Field of Search ..... 345/74, 75; 313/305–310, 313/336, 351; 315/169.3

[56] References Cited

U.S. PATENT DOCUMENTS

| | | | |
|---|---|---|---|
| 3,775,630 | 11/1973 | Minamikawa et al. | 313/305 |
| 4,578,614 | 3/1986 | Gray et al. | 313/309 |
| 4,908,539 | 3/1990 | Meyer | 313/309 |
| 5,012,153 | 4/1991 | Atkinson et al. | 313/309 |
| 5,189,341 | 2/1993 | Itoh et al. | 313/336 |

FOREIGN PATENT DOCUMENTS

| | | |
|---|---|---|
| 0172089 | 2/1986 | European Pat. Off. . |
| 2662301 | 11/1991 | France . |
| 4-22038 | 1/1992 | Japan . |

*Primary Examiner*—Steven Saras
*Attorney, Agent, or Firm*—Staas & Halsey

[57] ABSTRACT

A field emitter array includes electron-beam source elements, each including a cathode for emitting electrons and a gate provided in the vicinity of the cathode. To emit electrons from the cathode by the field emission effect, a cathode voltage is applied to the cathode and a gate voltage is applied to the gate. An anode is arranged in proximity to the cathode and supplied with a positive anode voltage to capture electrons from the cathode in a first (e.g., normal or display) mode of operation. In a second (e.g., cleaning) mode of operation of the field emitter array, a negative anode voltage is supplied to the anode to urge electrons emitted by a first cathode, back toward a second cathode supplied with a cathode voltage which attracts electrons, to clean the second cathode.

15 Claims, 10 Drawing Sheets

Vk1
1st cycle
|Ve1|>|Ve2|>|Ve3|
Vx3

2(n-1)T
t
Ve1
Vk2
Vx1
Vx3
T t1
t3
t4
t2
Ve2
Ve3
Vk3
Vx2
Vx3

Ve2
Ve3
Vkn-1
2nd cycle
Vx2
Vx2

Ve2
Ve3
Vkn
Vx2

Ve2
(n-1)T

FIELD EMITTER ARRAY AND CLEANING METHOD OF THE SAME

This application is a continuation, of application Ser. No. 07/971,618, filed Nov. 6, 1992, now abandoned.

BACKGROUND OF THE INVENTION

1. Field of the Invention

The present invention generally relates to field emitter array devices and more particularly to a field emitter array device configured by a plurality of cathodes arranged in the form of a matrix.

2. Description of Related Art

A field emitter array causes an emission of electrons by inducing a deformation in the surface potential of a cathode. There, an intensive electric field is applied on the cathode, and electrons in the cathode are emitted therefrom by passing through the deformed potential barrier by the tunneling effect. To accomplish the emission of electrons, the field emitter array includes an electron beam source that in turn includes a cathode to which a negative voltage is applied and a gate electrode provided adjacent to the cathode for inducing an intensive electric field thereto. After emission from the cathode, the electrons are accelerated and captured by an anode electrode. The electron beam source of such a configuration can be fabricated with sizes on the order of several microns by using the microfabrication technique employed commonly in the fabrication of semiconductor devices. Thereby, it is possible to arrange minute electron-beam sources in a matrix shape over an extensive area. The field emitter array of such a configuration is expected to be used in high-speed arithmetic devices or high-speed and high-luminosity flat display devices.

FIG. 1 is a perspective view schematically illustrating a conventional field emitter array.

Referring to FIG. 1, a field emitter array is formed on an insulating base 10, and an insulating layer 11 is formed on the upper major surface of the base 10. There, a plurality of cathode electrodes 12 are formed on the lower major surface of the insulating layer 11 to extend in a first direction with a parallel relationship to each other. Further, a plurality of gate electrodes 13 are formed on the upper major surface of the above-mentioned insulating layer 11 to extend in a direction approximately perpendicular to the first direction, with a parallel relationship to each other. Electron beam generating sources 14 are formed in the above-mentioned insulating layer 11 in correspondence to the positions where the above-mentioned cathode electrodes 12 and the gate electrodes 13 intersect with each other. In an example shown in the FIG. 1, each of the electron beam sources 14 is formed of a plurality of electron-beam source elements. The entire apparatus shown in FIG. 1 is housed in a sealed vacuum vessel not illustrated.

FIG. 2 is an enlarged view of one of the electron-beam sources of FIG. 1.

Referring to FIG. 2, an electron-beam source 14 is provided in the insulating layer 11 typically made of silicon oxide in correspondence to a through-hole 11*a* formed at a position in correspondence to an intersection of the above-mentioned cathode electrode 12 and the gate electrode 13. The beam source 14 includes an emitter tip having a pointed cone shape. Typically, the emitter tip 15 is formed of Mo, and is formed on the cathode electrode 12. As shown in FIG. 2, the gate electrode 13 extends from the side wall of the through-hole 11*a* toward the emitter tip 15, and forms a narrow gap between itself and the emitter tip 15. By applying a positive voltage on the gate electrode 13 and simultaneously a negative voltage on the cathode electrode 12, an intensive electric field is established between the gate electrode 13 and the emitter tip 15. Such an electric field induces a deformation in the potential barrier on the surface of the emitter tip 15 and allows electrons in the emitter tip 15 to be emitted by the tunneling effect. Electrons thus emitted are accelerated by a positive voltage applied to an anode (not shown in FIGS. 1 and 2) provided opposite to the base 10, and are subsequently captured by the anode. When a fluorescent coating is provided in the vicinity of the anode, a visible image is formed according to a pattern of the emitted electron beam and the device can be used as a flat display panel. Such a flat display panel can be formed for example by forming the anode by a transparent conductive body coated with a fluorescent substance.

In such a field emitter array, it will be easily understood that a degradation in the electron beam emission occurs when a volatile substance such as a gas is absorbed by the emitter tip 15. Therefore, it is desirable and essential in the field emitter array to effect a cleaning process of the emitter tip 15 at predetermined intervals or at every start-up of the apparatus. In the vacuum tubes, it is generally practiced to provide a getter in the vacuum container for absorbing gas. On the other hand, in the field emitter array that does not use the thermal emission of electrons, the mere provision of a getter in the container is not sufficient to ensure satisfactory cleaning. Further, it should be noted that the external heating of the field emitter array shown in FIG. 1 is generally impossible once the field emitter array is assembled in an electronic apparatus.

FIG. 3 illustrates a process for cleaning the emitter tip 15 in a field emitter array which process is described in the Japanese Laid-open Patent Application No. 4-22038. It should be noted that the laid-open publication of the foregoing patent reference has occurred after the basic application of the present application has been filed. In FIG. 3, the base 10 is omitted for the sake of convenience of illustration. In this conventional method, an excitation voltage is applied across a pair of neighboring electron-beam sources 14*a* and 14*b* so that an electron beam is formed originating from the electron-beam source 14*a* and reaching the electron-beam source 14*b*. As a result, a volatile contaminant absorbed in the emitter tip 15*b* in the electron-beam source 14*b* is evaporated due to the energy of the electron-beam and is absorbed by a getter provided in the container.

Referring to FIG. 3, a negative voltage is applied to a cathode electrode 12*a* of the electron-beam source 14*a*, and a positive voltage is applied to a cathode electrode 12*b* of the neighboring electron-beam source 14*b*. An intense voltage is thereby applied between an emitter tip 15*a* formed on the cathode electrode 12*a* and an emitter tip 15*b* formed on the cathode electrode 12*b*. When that voltage reaches a level high enough to excite field emission of electrons in the emitter tip 15*a*, an electron beam is formed from the emitter tip 15*a* to the emitter tip 15*b*, and the energy of the beam causes a volatile substance on the emitter tip 15*b* to evaporate.

While the above-mentioned prior art reference does not make any reference to a voltage applied to the anode while effecting a cleaning process, it is a general practice to apply a positive voltage to the anode. FIG. 4 illustrates a potential distribution when applying a positive voltage to the anode of the electron-beam source shown in FIG. 3, wherein it should be noted that FIG. 4 is reversed left to right in relation to FIG. 3. It is assumed in the computations in FIG. 4 that the gate electrodes 13*a* and 13*b* are both grounded.

As can be seen from FIG. 4, under the condition that a positive voltage is applied to the anode, electrons emitted from the emitter tip 15*b* are mainly attracted by the anode electrode, even when a positive voltage is applied to the emitter tip 15*a*, and hardly ever reach the emitter tip 15*a*. In other words, a voltage applied to the anode electrode, provided opposite to the electron-beam source, exercises an essential influence on the efficiency of the cleaning process.

SUMMARY OF THE INVENTION

Accordingly, it is a general object of the present invention to provide a novel and useful field emitter array and a cleaning method thereof.

Another and more specific object of the present invention is to provide a field emitter array and a cleaning method thereof, which array and method allow for efficient cleaning thereof.

Another object of the present invention is to provide a field emitter array including an electron-beam source array for emitting electrons and an anode applied with a predetermined anode voltage for capturing said electrons emitted by said electron-beam source array. The electron beam source array also includes a plurality of electron-beam source elements, each of the electron-beam source elements in turn including a cathode for emitting electrons upon application of a cathode voltage thereto by the field emission effect, and a gate provided in the vicinity of the cathode for causing said emission of the electrons upon application of a predetermined gate voltage thereto. The field emitter array further includes electron repulsion means for urging the electrons emitted from the electron-beam source element toward the electron-beam source array. According to the present invention, the electrons emitted from a cathode in the electron beam source array have an increased probability of reaching another cathode in the electron beam source array due to the repulsion by the electron repulsion means. Accordingly, the cleaning of the cathode is achieved with an increased efficiency.

Another object of the present invention is to provide a method for cleaning a field emitter array that includes an electron-beam source array formed by arranging a plurality of electron-beam source elements, each of said electron-beam source elements in turn includes a cathode for emitting electrons upon application of a cathode voltage by the field emission effect and a gate provided in the vicinity of the cathode for causing the emission of electrons upon application of a predetermined gate voltage thereto. The field emitter array further includes an anode applied with a predetermined positive voltage for capturing the electrons emitted from the cathode of said electron-beam source elements. The method includes a step of forming an electron beam such that the electron beam connects a pair of the cathodes in the electron-beam source array, by applying a predetermined excitation voltage between the pair of cathodes. The method also includes a step of the applying a negative voltage to the anode electrodes, rather than the predetermined positive voltage, substantially concurrently to the step of forming the electron beam. According to the present invention, the efficiency of cleaning is substantially improved because of the urging of the electrons emitted by the electron-beam source elements, to the electron-beam source array.

Another object of the present invention is to provide a method for cleaning a field emitter array that includes an electron-beam source array formed by arranging a plurality of electron-beam source elements, each of said electron-beam source elements in turn including a cathode for emitting electrons upon application of a cathode voltage by the field emission effect and a gate provided in the vicinity of said cathode for causing the emission of electrons upon application of a predetermined gate voltage thereto. The field emitter array further includes an anode supplied with a predetermined positive voltage for capturing the electrons emitted from the cathode of the electron-beam source elements, said anode being divided into a plurality of anode elements. The method includes the step of selecting a pair of electron-beam source elements, each pair including a first electron-beam source element and a second electron-beam source element, and establishing an electron beam such that the electron beam connects a cathode in the first electron-beam source element and a cathode in the second electron-beam source element by applying a predetermined excitation voltage therebetween. The method also includes a step of applying negative voltages to the anode elements substantially concurrently to the step of establishing the electron beam in such a manner that said negative voltages increase in magnitude along a direction extending from the first electron-beam source element toward the second electron-beam source element. According to the present invention, an asymmetric electric field is established in the field emitter array between the anode and the electron-beam source elements, and the effect for urging the electrons toward the electron-beam source element to be cleaned is substantially enhanced.

DETAILED DESCRIPTION OF THE PREFERRED EMBODIMENTS

Figure 3:
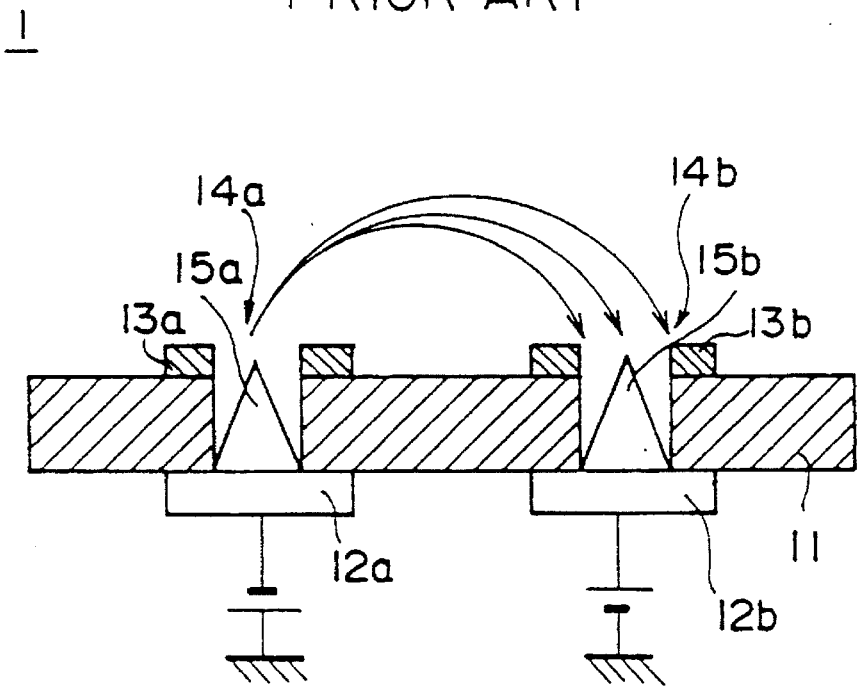
FIG. 3 PRIOR ART
FIG. 3 is a diagram showing a cleaning process of the convention field emitter array.
Figure 5:
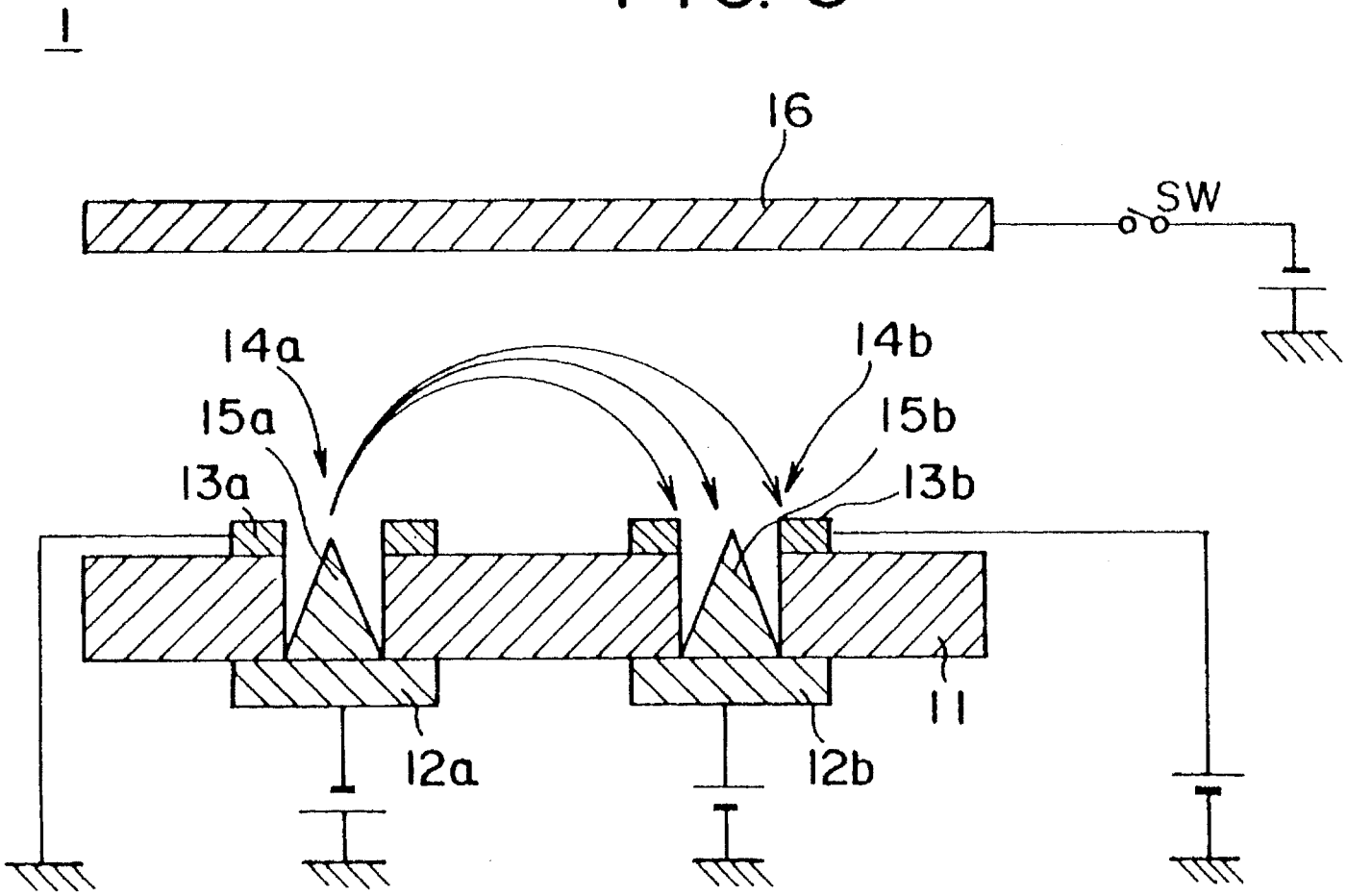
FIG. 5 is a diagram showing a cleaning process of the field emitter array according to a first embodiment of the present invention.

FIG. 5 shows the first embodiment of the present invention. FIG. 5 corresponds to FIG. 3 described earlier, and the base 10 is omitted from FIG. 5 for the sake of convenience. In FIG. 5, parts that correspond to parts in FIG. 3 are given the same reference numerals and the descriptions thereof are omitted.

Referring to FIG. 5, the present embodiment employs an anode electrode 16 that is provided to oppose the base 10 (not shown) as well as to the insulating layer 11 provided on the upper major surface of the base, and a negative voltage is applied to the anode electrode 16 instead of a positive voltage. There, a negative voltage is applied to the anode electrode 16 by closing a switch SW when effecting a cleaning process. At the same time, a negative voltage is applied to the cathode electrode 12*a* and a positive voltage applied to the cathode electrode 12*b*, so that electrons are emitted from the emitter 15*a* by the field emission effect and reach the emitter 15*b* along a path connecting the emitter tip 15*a* to the emitter tip 15*b*. According to this embodiment, since a negative voltage is applied to the anode electrode during a cleaning process, electrons emitted from the emitter tip 15*a* reach the emitter tip 15*b* with high efficiency, so that a cleaning process is effected efficiently. In normal operation, the switch SW is opened, and a positive voltage is applied to the anode 16.

Figure 6:
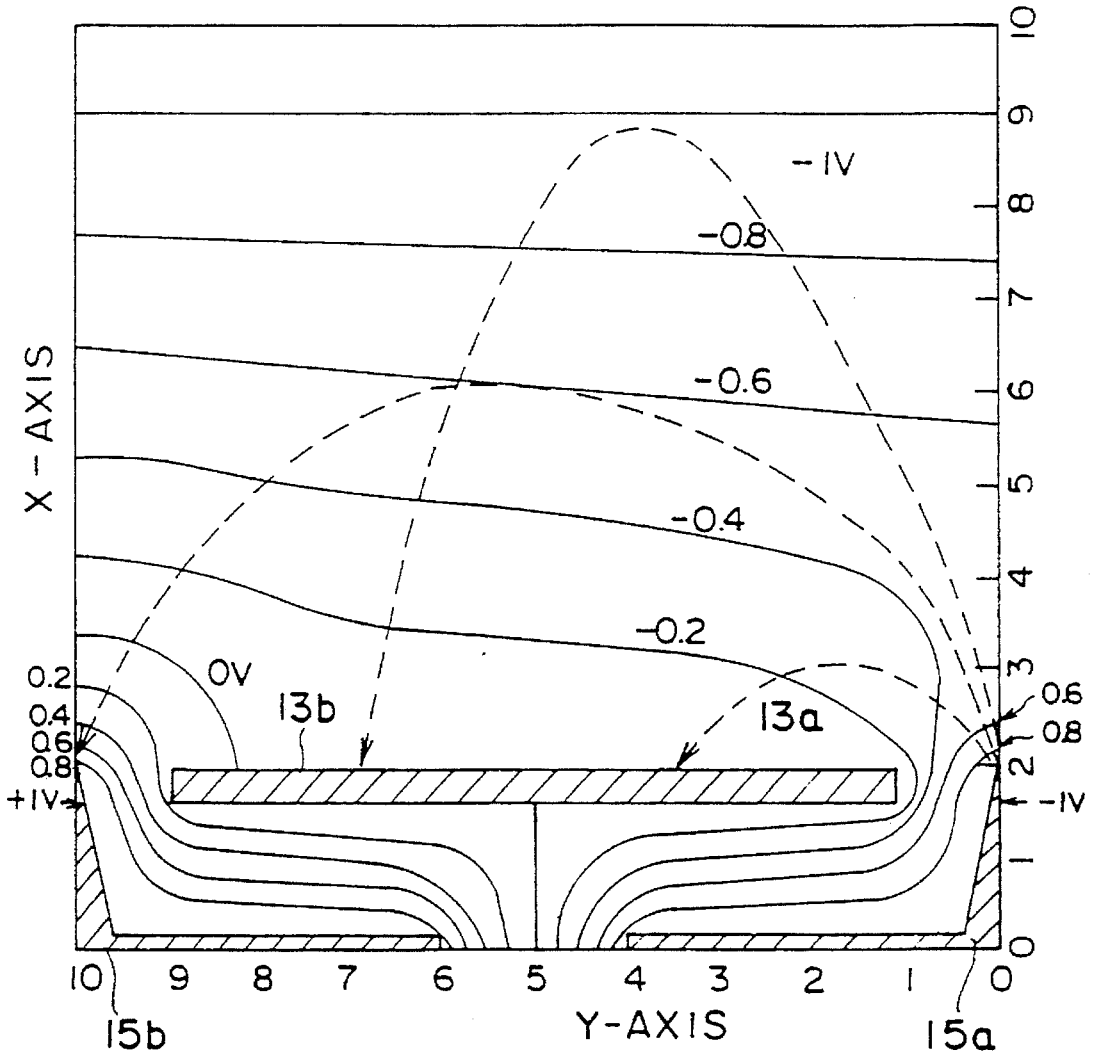
FIG. 6 is a diagram showing the principle of the cleaning process according to the first embodiment of the present invention.

FIG. 6 represents a potential distribution formed in a field emitter array when a voltage of −1 V is applied to the emitter tip 15*a*, a voltage of +1 V to the emitter tip 15*b*, and a voltage of −1 V to the anode electrode 16. As in the case of FIG. 3, FIG. 6 is reversed left to right in relation to FIG. 5. In the calculation of FIG. 6, it is assumed that the gate electrodes 13*a* and 13*b* are grounded.

Figure 4:
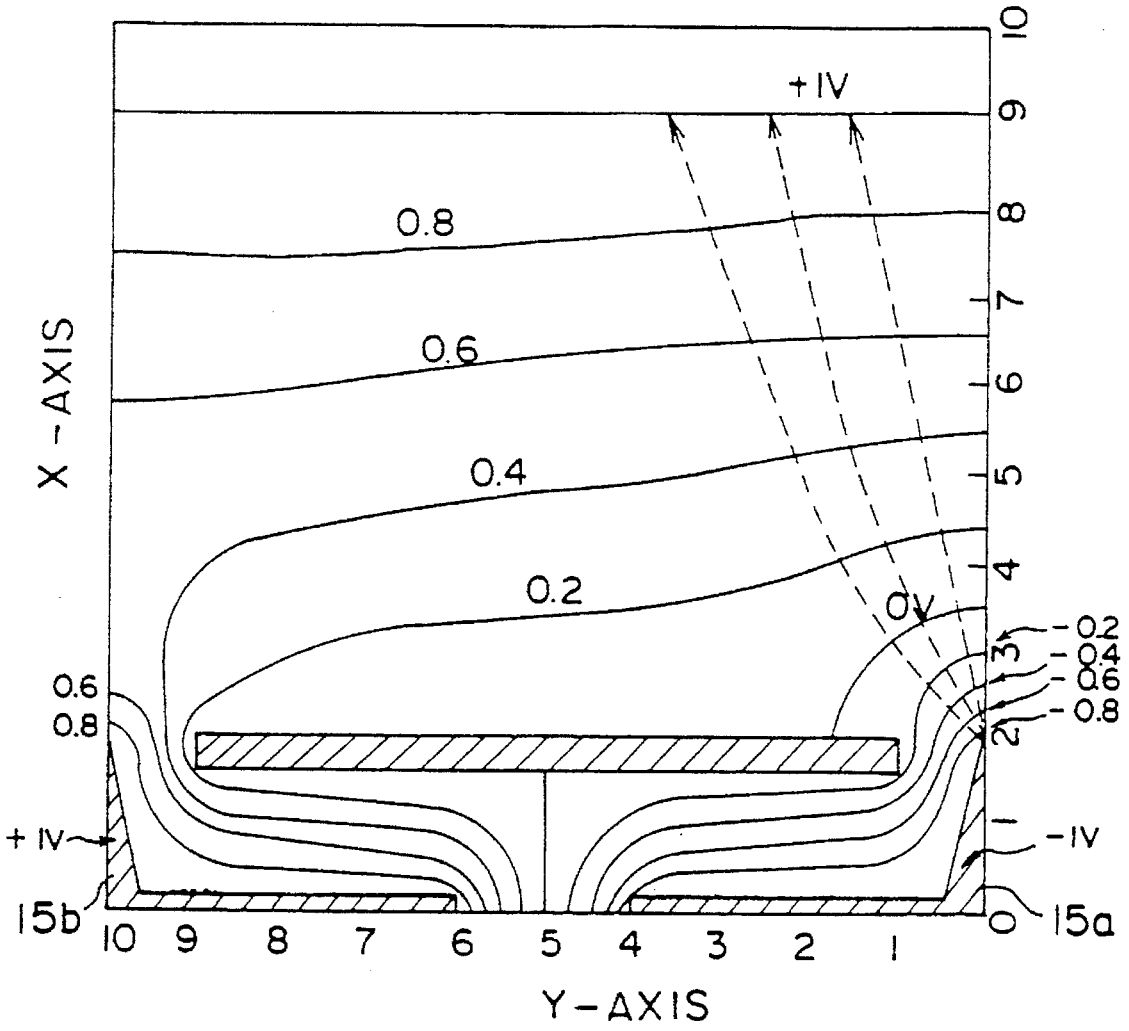
FIG. 4 is a diagram showing a result of calculation for obtaining a potential distribution appearing in the field emitter array in the conventional cleaning process.

As can be seen from FIG. 6, electrons emitted from the emitter tip 15*a* are repelled by the electric field created by the anode so that regardless of the angle of incidence of the electrons with respect to the anode, the electrons are urged to return to the emitter tip 15*b*. Some of the electrons are captured by the gate electrodes 13*a* and 13*b*, while others are captured by an intense electric field formed around the emitter tip 15*b* and collected by the emitter 15*b*. Comparing FIG. 6 with FIG. 4, it will be noted that potential distributions near the emitter tip 15*a* differ significantly over the potential distribution around the emitter tip 15*b*. It is evident that a potential distribution around the emitter tip 15*b* shown in FIG. 6 facilitates the collection of the electron beam to the end portion of the emitter tip 15*b*. While the magnitude of a negative voltage applied to the anode electrode depends on the configuration of the field emitter array, it is generally effective in this embodiment to set the magnitude of a negative voltage applied to the anode electrode to be larger than the voltage applied to the emitter tip 15*a*.

Figure 1:
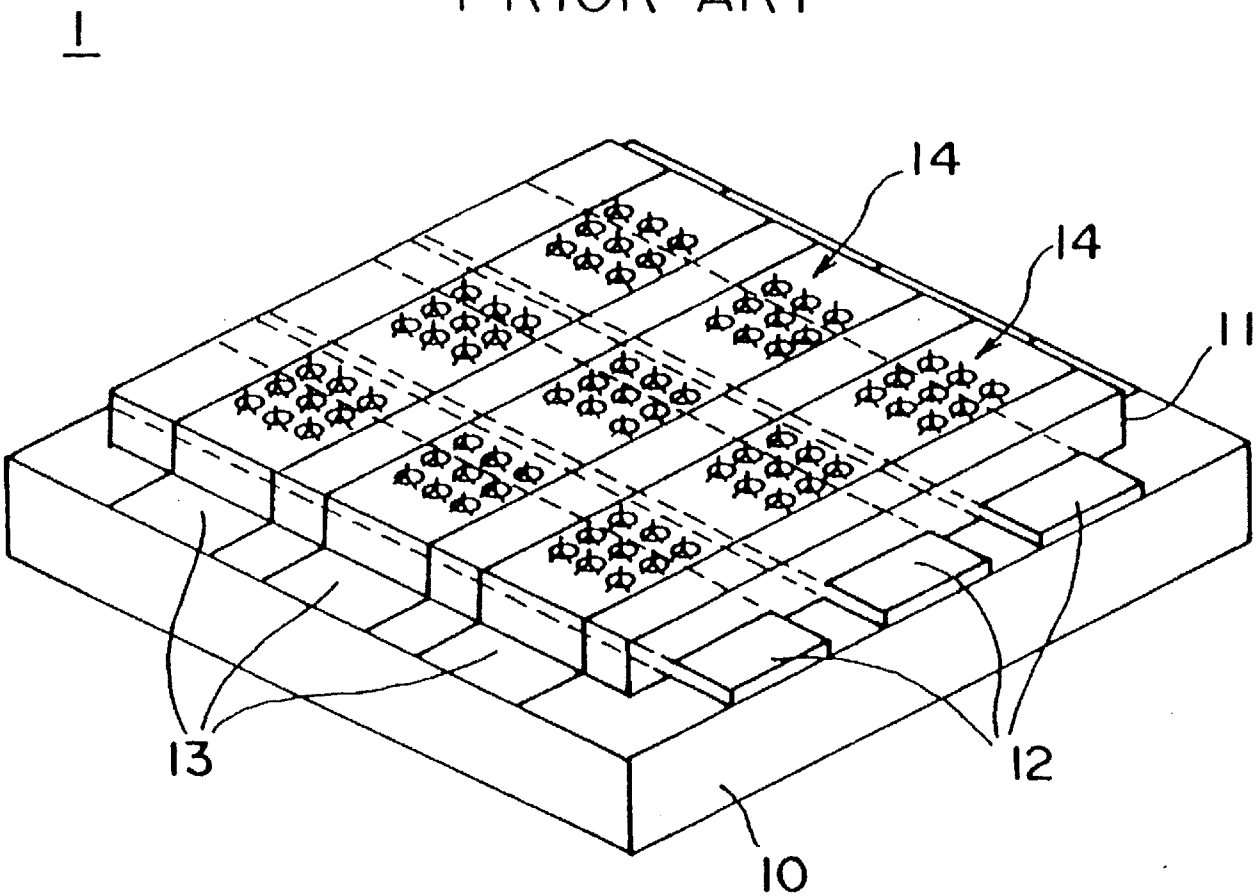
FIG. 1 PRIOR ART
FIG. 1 is a diagram showing the perspective view of a conventional field emitter array.
Figure 2:
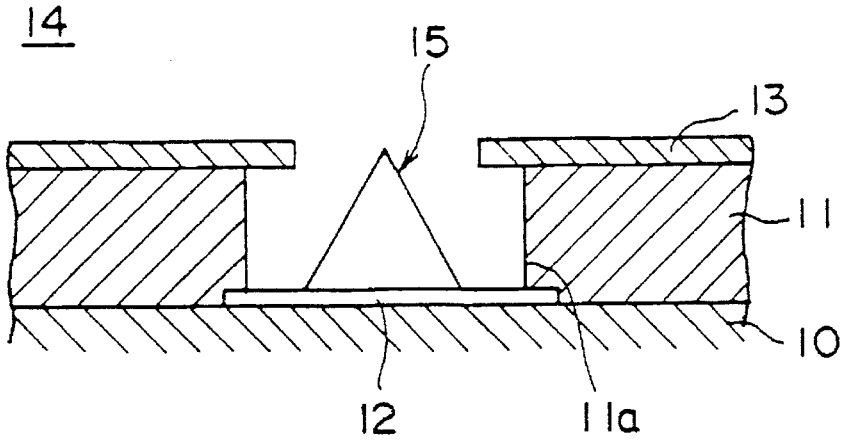
FIG. 2 PRIOR ART
FIG. 2 is a diagram showing an enlarged view of a part of the field emitter array in FIG. 1.

Next, a description of the second embodiment of the present invention will be made with reference to FIG. 7 illustrating a field emitter array 30. In the second embodiment, a pair of electron-beam sources are selected consecutively, starting from one end of an electron-beam source array and proceeding to the other end, and the above-mentioned excitation voltage is applied to the selected pair to form the electron beam connecting therebetween, as shown in FIG. 1.

Figures 7A, 7B, 7C:
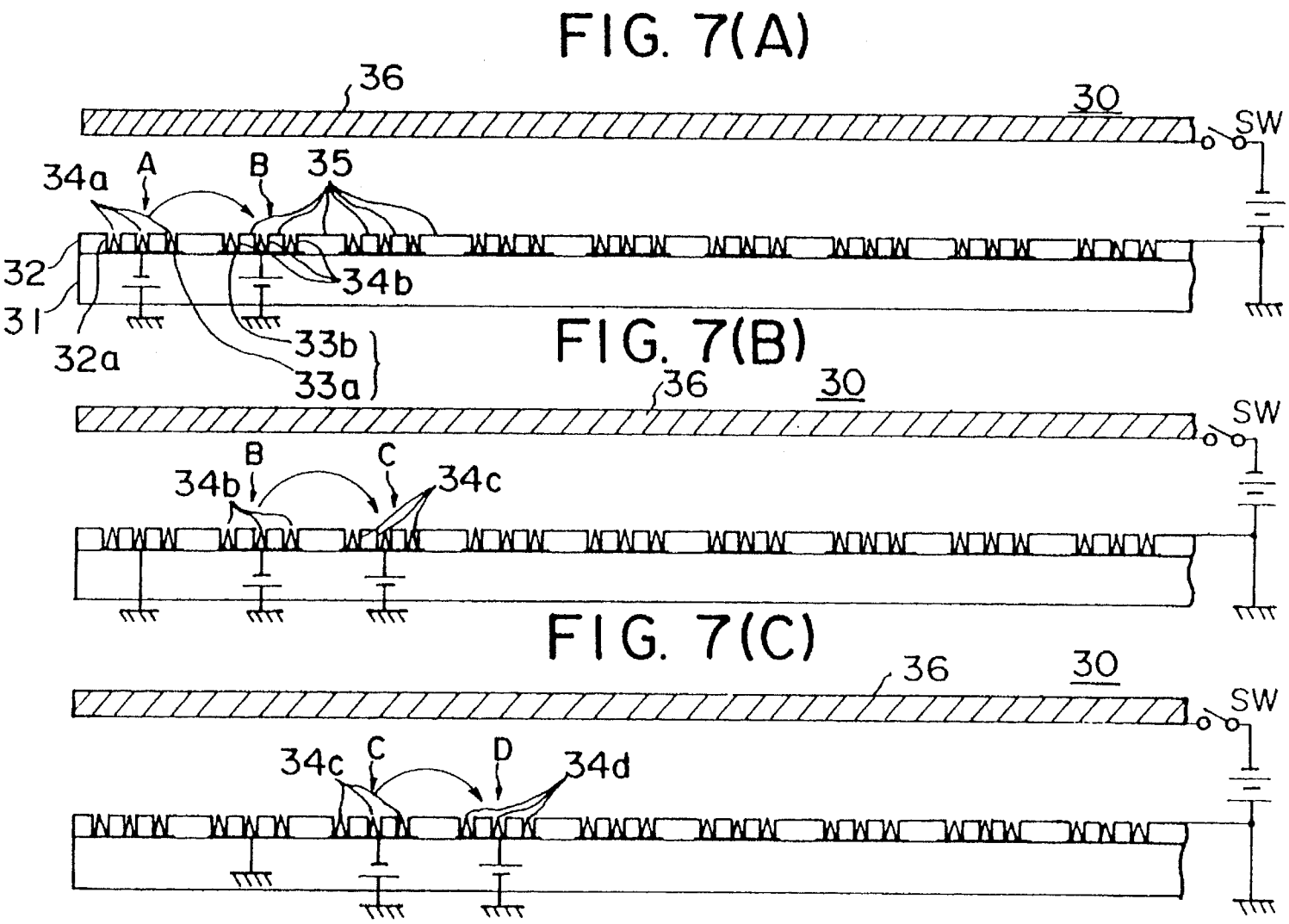
FIGS. 7(A), 7(B) and 7(C) are diagrams showing the cleaning process of the field emitter array according to a second embodiment of the present invention.

Referring to FIGS. 7(A) through 7(C), the field emitter array 30 comprises: an insulating layer 32 formed on an insulating base 31; cathode electrodes 33*a*, 33*b*, . . . provided at the boundary between the above-mentioned insulating layer base 31 and the insulating 32; through-holes 32*a* formed in the above-mentioned insulating layer 32 to expose the above-mentioned cathode electrodes 33*a*, 33*b*. . . ; emitter tips 34*a*, 34*b*, . . . provided in correspondence to the above-mentioned through-holes; gate electrodes 35 provided on the upper major surface of the above-mentioned insulating layer 32; and an anode electrode 36 provided to oppose to the above-mentioned emitter tips 34*a*, 34*b*, . . . . The emitter tips 34*a*, 34*b*, are arranged into a plurality of groups and form electron-beam sources A, B, C, D, . . . . In this illustration, the electron-beam source A is formed on one end of the electron-beam source array.

In a state shown in FIG. 7(A) , the electron-beam source A and the neighboring electron-beam source B are selected and an electron beam is formed to extend from the beam source A to the source B. Thereby, the emitter tip 34*b* in the beam source B is cleaned by the electron beam. After the electron-beam source B is cleaned in the process of FIG. 7(A), the process proceeds to a state shown in FIG. 7(B) wherein the electron-beam source B and the neighboring electron-beam source C are selected and an electron beam is formed to extend from the beam source B to the source C. Thereby, the emitter tip 34*c* in the beam source C is cleaned. Next, in a state shown in FIG. 7(C), the electron-beam source C and the electron-beam source D are selected, and the emitter tip 34*d* in the electron-beam source D is cleaned by an electron beam radiated from the electron-beam source C to the electron-beam source D.

In such a cleaning process, it should be noted one has to apply a large negative voltage to the electron-beam source A which is selected first for causing the emission of the electrons. It should be noted that the electron-beam source A is not subjected to any earlier cleaning process and hence a large excitation voltage is required to cause the desired electron emission. On the other hand, the electron- beam source B, which effects an electron emission in the process shown in FIG. 7(B), or the electron-beam source C, which effects an electron emission in the process shown in FIG. 7(C), has been cleaned already in the earlier process, so that a voltage required for field emission of electrons therefrom becomes lower than the excitation voltage used for the electron-beam source A.

FIGS. 8(A) through 8(E) are time charts illustrating how the above-mentioned cleaning process proceeds. FIG. 8(A) shows voltages applied to the above-mentioned electron-beam source A and timings of that application; FIG. 8(B) shows voltages applied to the above-mentioned electron-beam source B and timings of that application; FIG. 8(C) shows voltages applied to the above-mentioned electron-beam source C and timings of that application. Similarly, FIG. 8(D) shows voltages applied to the n-1th electron-beam source and timings of that application; FIG. 8(E) shows voltages applied to the nth electron-beam source and timings of that application.

As shown in FIG. 8(A) and(B), a negative voltage $V_{e1}$ is applied to the electron-beam source A in an interval $t_1$, and a positive voltage $V_{x1}$ is applied to the electron-beam source B at the same timing. After an electron beam is radiated from the electron-beam source A to the electron-beam source B in this state, a negative voltage $V_{e2}$ smaller in magnitude than the voltage $V_{e1}$ is applied to the electron-beam source B in an interval $t_3$, as shown in FIGS. 8(C) and (D). At the same time, a positive voltage $V_{x2}$, smaller in magnitude than the voltage $V_{x1}$, is applied to the electron-beam source C. As a result, an electron beam path from the electron-beam source B to the electron-beam source C is formed, so that the emitter tip of the electron-beam source C is cleaned. After that, the electron-beam sources are cleaned consecutively by sequentially selecting a next pair of the electron-beam sources and applying the voltages $V_{e2}$ and $V_{x2}$ between the selected electron-beam sources. As shown in FIG. 8(D) and 8(E), at the end of the process, the positive voltage $V_{x2}$ is applied to the above-mentioned n-1th electron-beam source, and the negative voltage $V_{e2}$ is applied to the nth electron-beam source which sources are located at the other end of the electron-beam source array.

Figure 8:
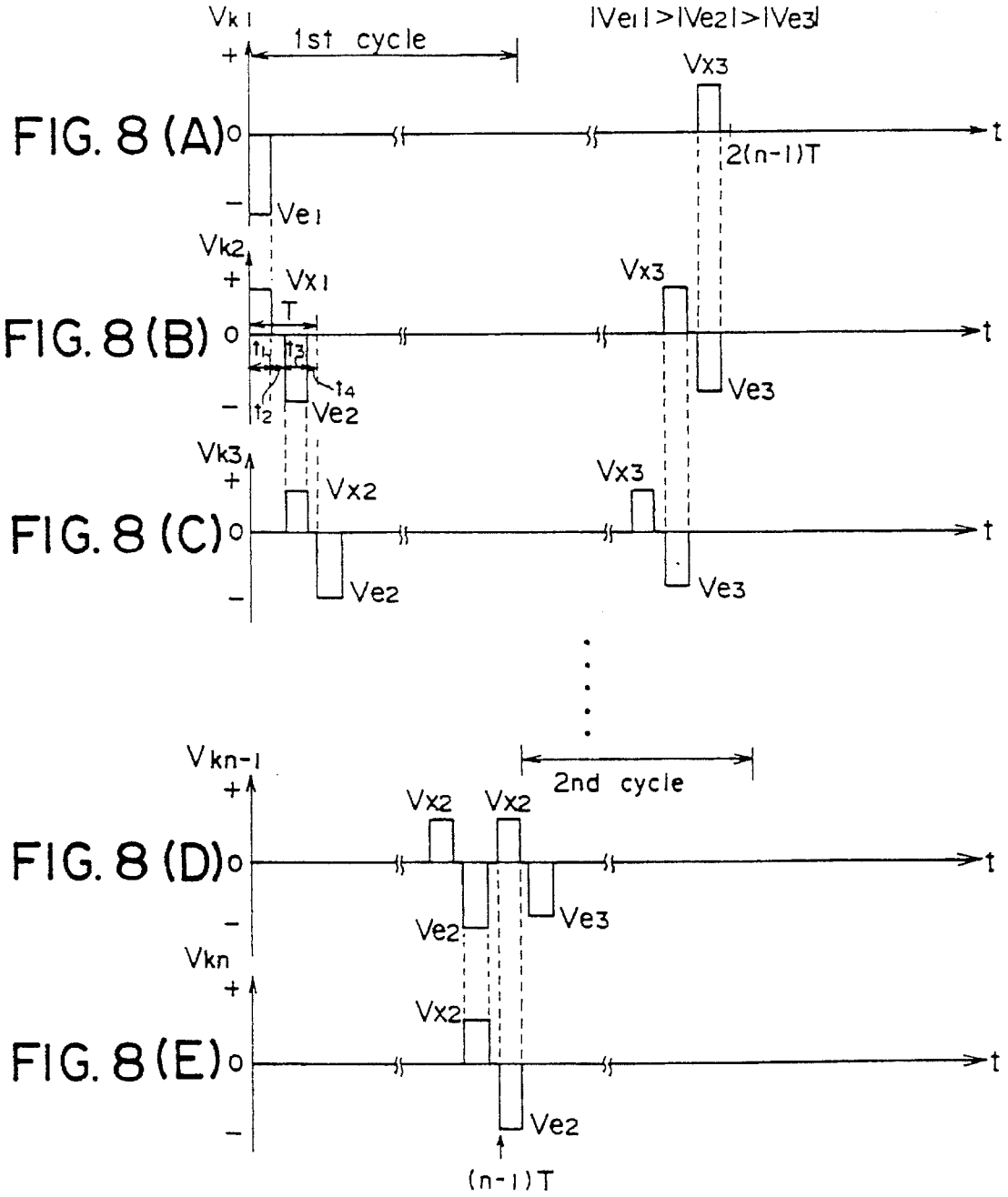
FIGS. 8(A), 8(B), 8(C), 8(D) and are diagrams showing the timing of the cleaning operation according to the second embodiment of the present invention.

The above-mentioned process can repeat itself a plurality of times as indicated in FIG. 8 as "1st cycle" and "2nd cycle". When repeating the process, in consideration of the fact that each of the electron-beam sources A, B, C, . . . . has already been subjected to at least one cleaning process, the applied negative voltage $V_{e3}$ is set to be smaller in magnitude than the above-mentioned voltage $V_{e2}$, and the applied positive voltage $V_{x3}$ is set to be smaller in magnitude than the above-mentioned voltage $V_{x2}$. Thereby, it is possible to minimize the wear of the emitter tips by gradually decreasing the level of excitation voltage as the cleaning proceeds. In the present embodiment, it is particularly advantageous to provide the electron-beam source A as a special, cleaning-purpose-only electron-beam source for initiating the cleaning process at the end or marginal region of the electron-beam source array. The voltage applied to the electron-beam source for effecting a cleaning process may be fixed at $V_x$ for easy control hereof.

Figure 9A:
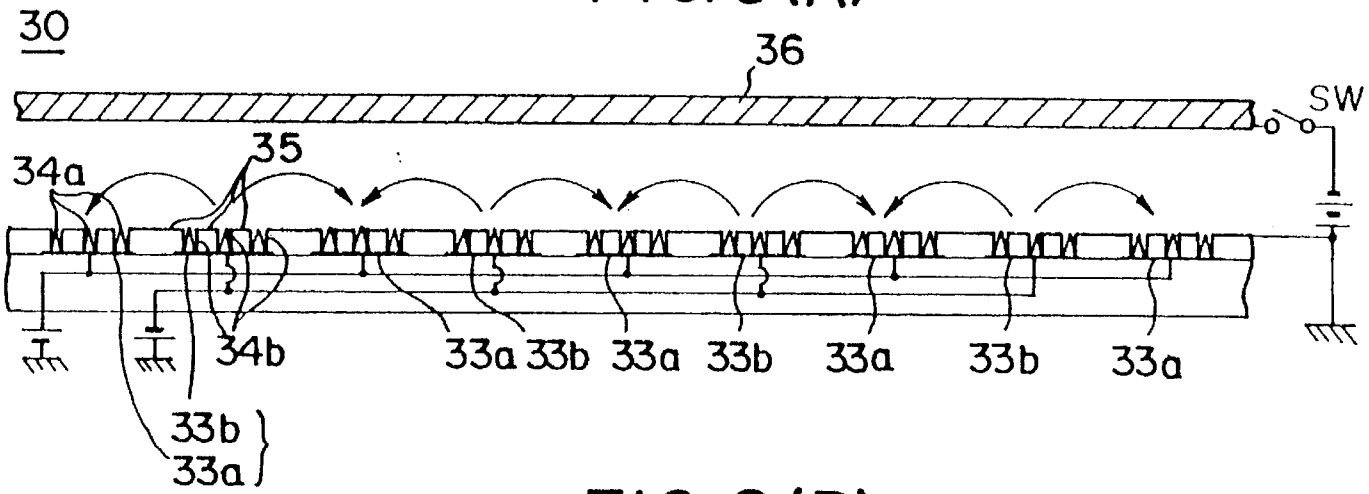
FIGS. 9(A) and 9(B) are diagrams showing the cleaning process of the field emitter array according to a third embodiment of the present invention.

Next, a third embodiment of the present invention will be described with reference to FIGS. 9(A) and 9(B). In FIGS. 9(A) and (B), those parts that were already described are given with the same reference numerals as in the previous drawings, and the description thereof will be omitted. In FIGS. 9(A) and (B), electron-beam sources are identified by the numerals given to the cathode electrodes.

Referring to FIG. 9(A), a plurality of electron-beam sources, independently driven during normal operation, are grouped into two, mutually adjacent electron-beam source groups 33*a* and 33*b* during the cleaning process. In a state shown in FIG. 9(A), a positive voltage is applied to the electron-beam source group 33*a*, and a negative voltage is applied to the electron-beam source group 33*b*. A negative voltage is applied tc the anode electrode 36 by closing the switch SW. In this state, an electron beam is radiated from each electron-beam source group 33*b* to respective sources of the source group 33*a*, so that the emitter tips in the electron-beam source group 33*a* are cleaned. For example, the electron-beam source group 33*a* may represent the electron-beam source group corresponding to drive lines having an odd number, and the electron-bean source group 33*b* may represent the electron-beam source group corresponding to drive lines having an even number. See the perspective view of FIG. 1 and the arrangement of the cathode and gate electrodes 12 and 13 shown therein.

Figure 9B:
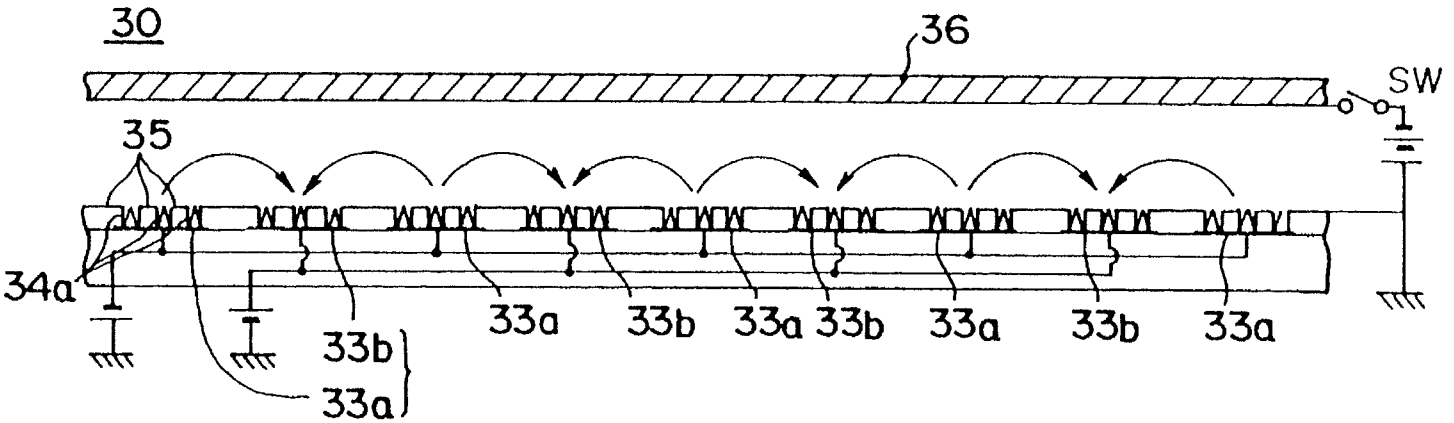

In a process shown in FIG. 9(B) following the process shown in FIG. 9(A), the voltage applied to the electron-beam sources is reversed, i.e., a negative voltage is applied to the electron-beam source group 33*a*, and a positive voltage is applied to the electron-beam source group 33*b*, while the positive voltage applied to the anode electrode 36 remains the same. In this state, the emitter tips in the electron-beam source group 33*b* are cleaned by the electron-beams emitted from the electron-beam source group 33*a*. The cleanness of the emitter tips in each electron-beam source group is gradually improved, by repeating the processes shown in FIGS. 9(A) and 9(B) in an alternating manner.

Figures 10A, 10B:
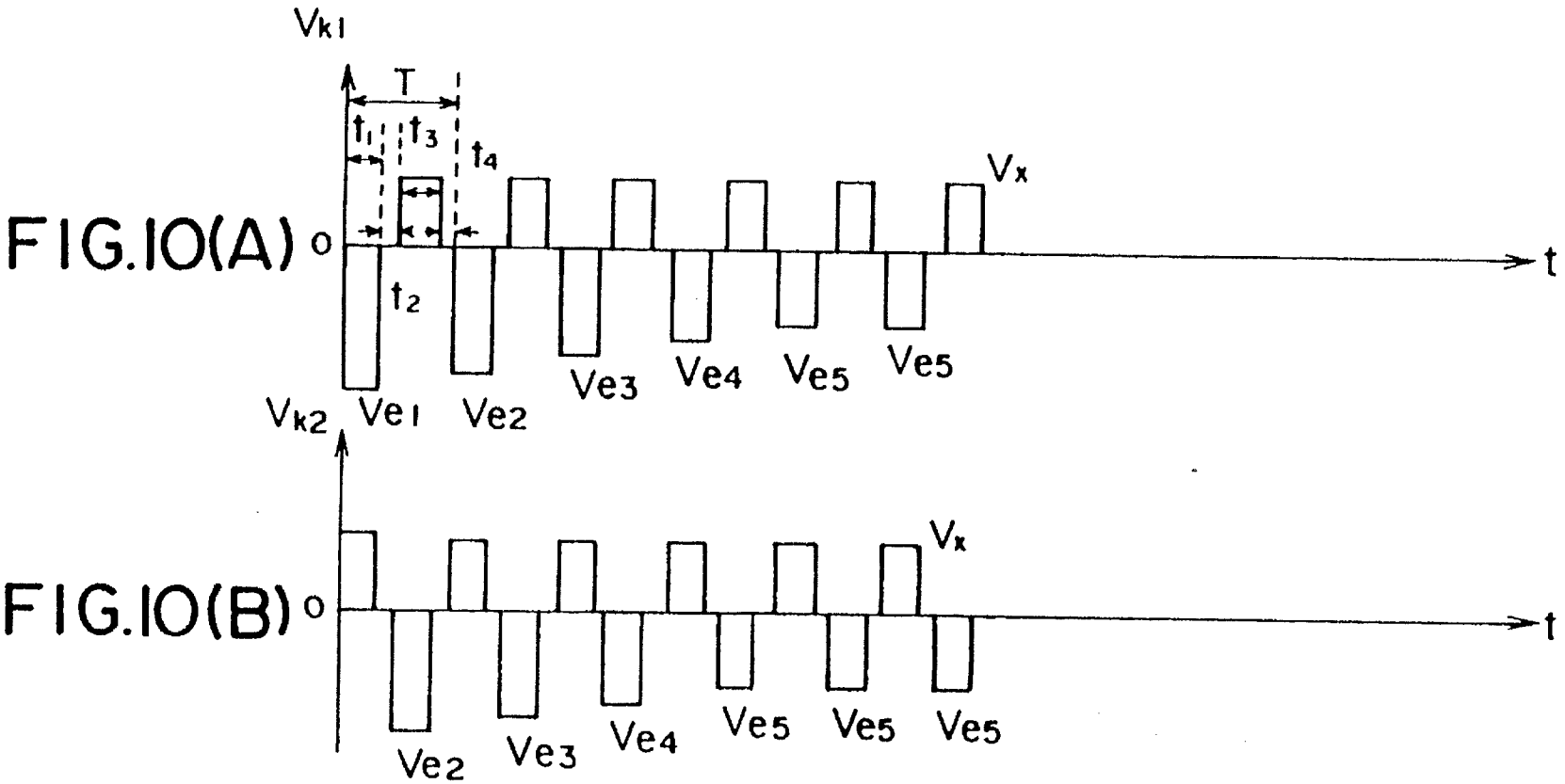
FIG. 10(A) and 10(B) are diagrams showing the timing of cleaning operation according to a third embodiment of the present invention.

FIGS. 10(A) and 10(B) show voltages applied to the electron-beam source groups 33*a* and 33*b* when repeating the processes shown in FIGS. 9(A) and 9(B) in an alternating manner, wherein FIG. 10(A) shows voltages applied to the electron-beam source group 33*a*, while FIG. 10(B) shows voltages applied to the electron-beam source group 33*b*.

As can be seen from FIGS. 10(A) and 10(B), at the interval $t_1$, the negative voltage $V_{e1}$ is applied to the electron-beam source group 33*a*, and the positive voltage $V_x$ is applied to the electron-beam source group 33*b*. At the next interval $t_3$, separated from $t_1$ by the interval $t_2$, the positive voltage $V_x$ is applied to the electron-beam source group 33*a*, and the negative voltage $V_{e2}$, smaller in magnitude than the previous negative voltage $V_{e1}$ is applied to the electron-beam source group 33*b*. As the above-mentioned process is repeated, the magnitude of the negative voltages is controlled to decrease as per $V_{e3}$, $V_{e4}$, $V_{e5}$, . . . . Upon reaching the voltage $V_{e5}$, the negative voltage is maintained at a constant level. By setting the excitation voltage in this way, a maximum cleaning effect is achieved while minimizing wear of the emitter tips. The number of electron-beam sources contained in the electron-beam source groups 33*a* and 33*b* and cleaned simultaneously may be set as appropriate depending on a adsorption capability of the getter not shown in the drawing.

Figure 11:
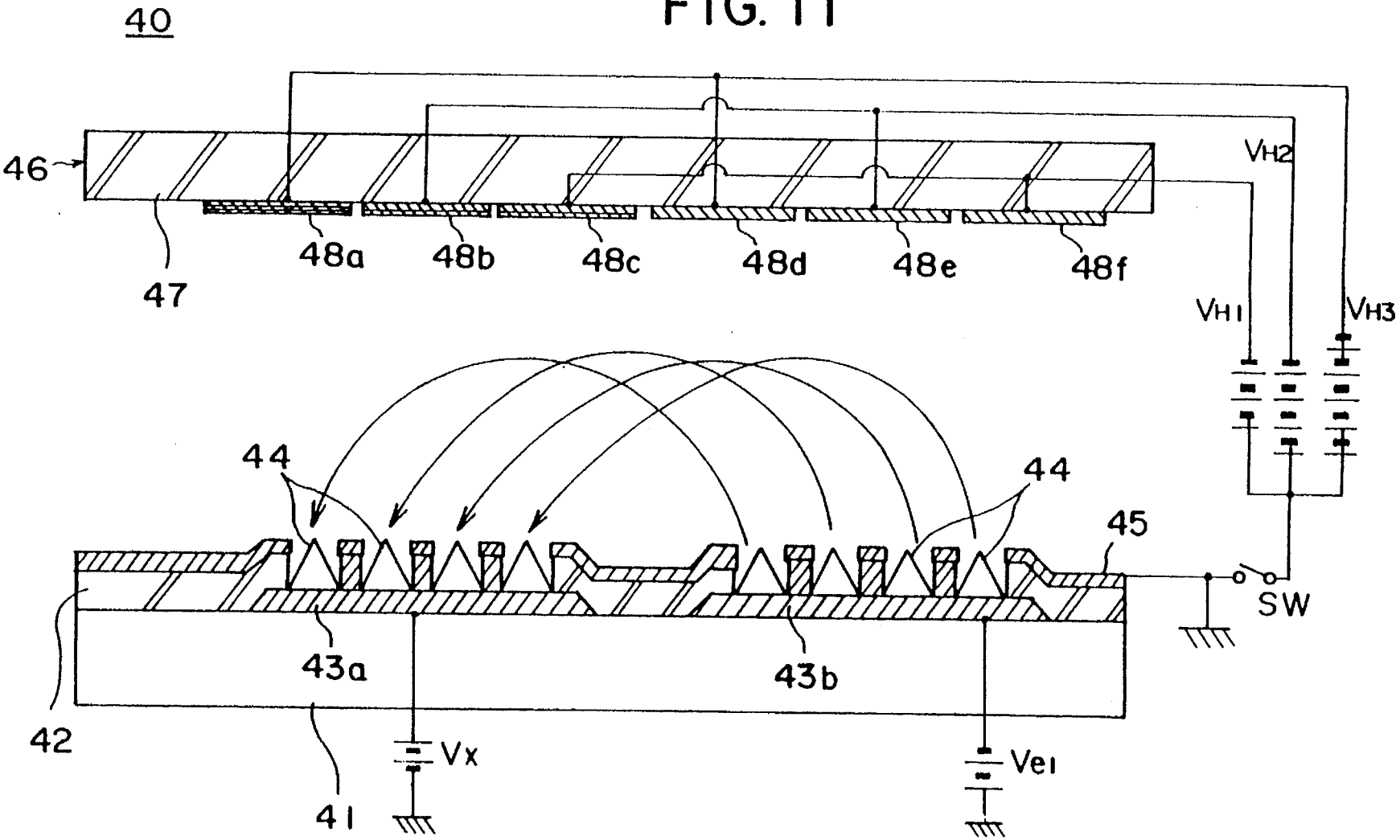
FIG. 11 is a diagram showing the cleaning process of the field emitter array according to a fourth embodiment of the present invention.

Next, a description will be given of the fourth embodiment of the present invention with reference to FIG. 11, wherein FIG. 11 illustrates a field emitter array 40 according to the fourth embodiment of the present invention.

Referring to FIG. 11, the field emitter array 40 is formed on an insulating base 41, on which base formed an insulating film 42. Cathode electrodes 43*a* and 43*b*, corresponding to electron-beam sources 43*a* and 43*b*, are provided at the boundary between the insulating film 42 and the base 41. A plurality of through-holes, corresponding to the cathode electrodes 43*a* and 43*b*, are formed in the insulating film 42. On the surfaces of the cathode electrodes 43*a* and 43*b*, there are provided one or more emitter tips 44*s* each having a cone shape in correspondence to the part exposed by the through-holes. Further, gate electrodes 45 are formed on the upper major surface of the insulating film 42. Further. There is provided an insulating base 47 above the above-mentioned base 41 as illustrated in FIG. 11, and the base 47 carries thereon a plurality of electrically separated anode electrode elements 48*a*, 48*b*, . . . at the side facing the above-mentioned electron-beam sources. The electrode elements 48*a*, 48*b*, . . . and the insulating base 47 as a whole form an anode 46.

FIG. 11 further shows a configuration by which the emitter tips 44 are cleaned in a field emitter array of this configuration. In the illustration, the negative voltage $V_{e1}$ is applied to the emitter tips 44 formed on the cathode electrode 43*b*, and the positive voltage $V_X$ is applied to the emitter tips 44 formed on the cathode electrode 43*a*, to that an electron beam is radiated from the plurality of emitter tips in the electron-beam sources 43*b* to the plurality of emitter tips in the electron-beam sources 43*a*, so that the emitter tips 44 in the electron-beam sources 43*a* are cleaned.

In this embodiment, as in the previous embodiments, a negative voltage is applied to the anode electrode elements 48*a*, 48*b*, . . . . This embodiment is unique in that three kinds of power supplies for generating negative voltages VH1, VH2, VH3 are provided as anode power supplies (VH1<VH2<VH3), and these negative voltages VH1, VH2, and VH3 are sequentially applied to three anode electrode elements 48*f*, 48*e*, and 48*d* arranged in a row, and also to the anode electrode elements 48*c*, 48*b*, 48*a* arranged in a row. As a result of this arrangement, an asymmetric potential distribution is formed increasing in magnitude from the anode electrode element 48*f* to the element 48*d*, and also from the anode electrode element 48*c* to the element 48*a*, with the result that a trajectory, along which the density of the electron beams becomes maximum, is bent toward the electron-beam sources 43*a*, and electrons are captured by the emitter tips 44 with high efficiency. The values of the voltages VH1, VH2, and VH3 are set, for example, to increase generally linearly with the positions of the electrode elements. For example. VH1 and VH3 are controlled to be 20% different from each other in magnitude.

The above-mentioned cleaning process may be achieved at the vacuum sealing process of the field emitter array, which process is included in the processes for manufacturing a field emitter array. The volatile substance is absorbed onto the surface of the emitter tip more or less immediately after a sealing process thereof, so there is a need for a cleaning process to be effected before shipping the device. In such a process carried out before shipping, it is effective to apply the intense negative voltage $V_{e1}$ to the electron-beam source A specifically provided for the cleaning purpose as described with reference to FIG. 8(A). It is convenient, in a case where a field emitter array is built into an electronic apparatus and then shipped, to carry out a cleaning process right after turning on the power of an electronic device. Generally, a variety of checking and diagnosing programs are executed right after turning on the power of an electronic device, therefore, by effecting a cleaning process during this initial period, an amount of extra time, required for a cleaning process, could be saved. Also, since such a cleaning process does not require a high temperature, there is no fear of adversely affecting other parts of an electronic apparatus. It is possible, in order to deal with emitter tip gas absorption related to age thereof, to form a configuration such that an operating time of a field emitter array is monitored by means of a timer, so that a cleaning process be initiated after a predetermined period of time elapses. Another configuration is possible such that a decrease of an anode current is monitored, and an alarm lamp is lighted when the anode current drops below a predetermined level, thus indicating a need for a cleaning process.

The present invention is not limited to the above embodiments, and various other changes and modifications may be made without departing from the scope of the claims.

What is claimed is:

1. A method for cleaning a field emitter array that includes an electron-beam source array formed by arranging a plurality of electron-beam source elements, each of said electron-beam source elements including a cathode for emitting electrons and a gate provided in the vicinity of said cathode, a predetermined cathode voltage being applied to said cathode and a predetermined gate voltage being applied to said gate, to emit electrons from said cathode by field emission effect in a first mode of operation of the field emitter array, and an anode arranged facing said electron-beam source elements in proximity to said cathode of each of said electron-beam source elements, applied with a predetermined positive voltage for capturing said electrons emitted from at least one cathode of said electron-beam source elements in the first mode of operation of the field emitter array, said method comprising the steps of:

(a) forming an electron beam in a second mode of operation such that the electron beam exists between a cathode pair in a pair of said electron-beam source elements in said electron-beam source array by applying a predetermined excitation voltage between said cathode pair; and (b) applying a predetermined negative voltage to said anode in place of said predetermined positive voltage in the second mode of operation of the field emitter array, substantially concurrently with said forming in step (a).

2. A method as claimed in claim 1, wherein said plurality of electron-beam source elements is divided into a plurality of groups each including a plurality of electron-beam source elements, and wherein said excitation voltage is applied between the cathodes in a first electron-beam source element group included in said plurality of groups, and the cathodes in a second electron-beam source element groups included in said plurality of groups.

3. A method as claimed in claim 1, further comprising the step of:

c) sequentially selecting neighboring pairs of electron-beam source elements, starting from one end of the said electron-beam source array and proceeding to the other, said steps (a) and (b) being performed after each sequential section in said step (c), said predetermined excitation voltage of said step (a) being applied between the cathodes of each selected neighboring pair of electron-beam source elements.

4. A method as claimed in claim 3, wherein said step (c) includes the substeps of c1) selecting a first pair of electron-beam source elements including first and second electron-beam source elements, and c2) selecting a second pair of electron-beam source elements including the second electron-beam source element and a third electron-beam source element.

5. A method as claimed in claim 4, wherein said substep (c1) is performed before said substep (c2), and wherein the predetermined excitation voltage applied in said step (a) after the substep (c2), is less than the predetermined excitation voltage applied in said step (a) after the substep (c1).

6. A method as claimed in claim 1, wherein said step (a) is repeated between neighboring pairs of electron-beam source elements in such a manner that said predetermined excitation voltage is gradually decreased in magnitude.

7. A method as claimed in claim 1, wherein the first mode of operation is a display mode and the second mode of operation is a cleaning mode.

8. A method as claimed in claim 1, wherein said second mode of operation is a cleaning mode performed before using the field emitter array in the first mode of operation.

9. A field emitter array comprising:

an electron-beam source array for emitting electrons, said electron-beam source array including a plurality of electron-beam source elements, each of said electron-beam source elements including a cathode for emitting electrons and a gate provided in the vicinity of said cathode, a cathode voltage being applied to said cathode and a predetermined gate voltage being applied to said gate, to emit electrons from said cathode by field emission effect in a first mode of operation of the field emitter array;

an anode arranged facing said plurality of electron-beam source elements in proximity to the cathode of each of said electron-beam source elements, supplied with a positive anode voltage for capturing said electrons emitted by at least one cathode of said electron-beam source array in the first mode of operation of the field emitter array; and electron repulsion means for urging said electrons emitted from said electron-beam source elements toward said electron-beam source array, by applying a negative anode voltage to said anode in a second mode of operation of said field emitter array, said electron repulsion means including a power source for applying the negative anode voltage to said anode, and switching means operated when cleaning said electron-beam source elements, for applying to said anode, said predetermined negative voltage generated by said power source.

10. A method for cleaning a field emitter array that includes an electron-beam source array formed by arranging a plurality of electron-beam source elements, each of said electron-beam source elements including a cathode for emitting electrons and a gate provided in the vicinity of said cathode, a predetermined cathode voltage being applied to said cathode and a predetermined gate voltage being applied to said gate, to emit electrons from said cathode by field emission effect in a first mode of operation of the field emitter array, and an anode arranged facing said electron-beam source elements in proximity to said cathode of each of said electron-beam source elements, applied with a predetermined positive voltage for capturing said electrons emitted from at least one cathode of said electron-beam source elements, said anode being divided into a plurality of anode elements, in the first mode of operation of the field emitter array, said method comprising the steps of:

(a) selecting at least one pair of said electron-beam source elements, each pair including a first electron-beam source element and a second electron-beam source element;

(b) generating at least one electron beam in a second mode of operation such that each electron beam exists between the cathode in said first electron-beam source element and a cathode in said second electron-beam source element, by applying a predetermined excitation voltage therebetween; and (c) applying negative voltages to said anode elements substantially concurrently with said generating in step (b) in such a manner that said negative voltages increase in magnitude along a direction extending from said first electron-beam source element toward said second electron-beam source element.

11. A method as claimed in claim 10, wherein said step (a) includes a substep of selecting a first electron-beam source element group and a second electron-beam source element group such that said first electron-beam source element group includes a plurality of electron-beam source elements including said first electron-beam source element, and such that said second electron-beam source element group includes a plurality of electron-beam source elements including said second electron-beam source element, such that an electron beam is generated in said step (b) in such a manner to exist between a plurality of cathode groups in said first electron-beam source element group and a plurality of cathode groups in said second electron-beam source element group.

12. A method as claimed in claim 10, wherein said first mode of operation is a display mode and the second mode of operation is a cleaning mode.

13. A method as claimed in claim 10, wherein said second mode of operation is a cleaning mode performed before using the field emitter array in the first mode of operation.

14. A field emitter array comprising:

an electron-beam source array for emitting electrons, said electron-beam source array including a plurality of electron-beam source elements, each of said electron-beam source elements including a cathode for emitting electrons and a gate provided in the vicinity of said cathode, a cathode voltage being applied to said cathode and a predetermined gate voltage being applied to said gate, to emit electrons from said cathode by field emission effect in a display mode of operation of the field emitter array;

an anode arranged facing said plurality of electron-beam source elements in proximity to the cathode of each of said electron-beam source elements, supplied with a positive anode voltage for capturing said electrons emitted by at least one cathode of said electron-beam source array in the first mode of operation of the field emitter array; and electron repulsion means for urging said electrons emitted from said electron-beam source elements toward said electron-beam source array, by applying a negative anode voltage to said anode in a cleaning mode of operation of said field emitter array.

15. A field emitter array comprising:

an electron-beam source array for emitting electrons, said electron-beam source array including a plurality of electron-beam source elements, each of said electron-beam source elements including a cathode for emitting electrons and a gate provided in the vicinity of said cathode, a cathode voltage being applied to said cathode and a predetermined gate voltage being applied to said gate, to emit electrons from said cathode by field emission effect in a first mode of operation of the field emitter array;

an anode arranged facing said plurality of electron-beam source elements in proximity to the cathode of each of said electron-beam source elements, supplied with a positive anode voltage for capturing said electrons emitted by at least one cathode of said electron-beam source array in the first mode of operation of the field emitter array; and electron repulsion means for urging said electrons emitted from said electron-beam source elements toward said electron-beam source array, by applying a negative anode voltage to said anode in a cleaning mode of operation of said field emitter array performed before using said field emitter array in the first mode of operation.

* * * * *